United States Patent [19]

Martinek

[11] Patent Number: 4,915,051

[45] Date of Patent: Apr. 10, 1990

[54] BOAT GUIDANCE STABILIZER

[76] Inventor: Joseph R. Martinek, 4613 S. Kalispell Way, Aurora, Colo. 80015

[21] Appl. No.: 162,286

[22] Filed: Feb. 29, 1988

[51] Int. Cl.[4] ..... B63H 25/38

[52] U.S. Cl. ..... 114/170; 114/162

[58] Field of Search ..... 114/144 R, 160, 170, 114/172, 199, 162, 163, 161; 440/62; 188/83, 65.1; 242/156.1, 100.1, 107.12; 254/213

[56] References Cited

U.S. PATENT DOCUMENTS

| | | | |
|---|---|---|---|
| 273,617 | 3/1883 | Sickels | 114/160 |
| 3,188,882 | 6/1965 | Whitehouse | 114/160 |

*Primary Examiner*—Sherman D. Basinger
*Assistant Examiner*—Edwin L. Swinehart
*Attorney, Agent, or Firm*—Joseph C. Herring

[57] ABSTRACT

A stabilizer for controlling the steering of boats is made of an attachment plate, a friction controller and a spool; the attachment plate is attached to the tiller, rudder or an extension of either. The spool is mounted on the attachment plate and the friction controller is connected to the attachment plate via a spool post and is moved to increase or decrease pressure on the spool. The spool has, on its edge, a modified groove which can have a single knot hole, or can have one or more groove enlargements, discontinuities and/or can be zigzagged. A line is attached to the boat on one side of the stabilizer, wound around the spool for several turns and attached to the boat on the other side. The line is knotted at approximately the midpoint for use with a knot hole. Preferably the two sides of the line are then linked on the opposite side of the spool. This mechanism allows excessive pressure against the rudder to move an unattended tiller in emergencies. It also allows the person controlling the direction of the boat to move the tiller against the resistance of the friction when necessary to reposition the rudder.

17 Claims, 4 Drawing Sheets

BOAT GUIDANCE STABILIZER

BACKGROUND OF THE INVENTION

Stabilizers mounted on the tiller or rudder are used to hold small boats on course without constant attendance by the helmsman. Such devices are particularly needed in boats sailed by a single person.

Stabilizers are known in the art. An example is taught in U.S. Pat. No. 1,401,290 issued to C. W. A. Taylor titled "Rudder Brake". In the device taught, a line passes around a drum or sleeve and is attached to the sides of the boat. The rotation of the drum or sleeve is limited by a friction-based device. The described stabilizer, because of its complexity and resulting higher expense, finds little use on small boats.

A simply constructed stabilizer is needed which can be used on the smallest row boats and sail boats, e.g., the sun fish, sail fish or snipe class boats, as well as larger boats. Such stabilizers need to be relatively inexpensive and simple for assembly, operation and repair. The device of this invention can be made quite simply for the smallest boats or in more complex forms for larger boats.

SUMMARY OF THE INVENTION

A stabilizer for controlling the steering of boats is made of an attachment plate, a friction controller and a spool. The attachment plate is attached to the tiller, rudder, etc. The spool is mounted on the attachment plate. The friction controller is connected to the attachment plate via a spool post and is moved to increase or decrease pressure on the spool. The spool has, on its edge, a modified groove which can have a single knot hole or discontinuity, or can have one or more groove enlargements and/or can be zigzagged. A line is attached to the boat on one side of the stabilizer, wound around the spool for several turns and attached to the boat on the other side.

This mechanism allows the person controlling the direction of the boat to move the tiller against the resistance of the friction when necessary to reposition the rudder. It also allows excessive pressure against the rudder to move an unattended tiller in emergencies.

DETAILED DESCRIPTION OF THE DRAWINGS

Figure 1:
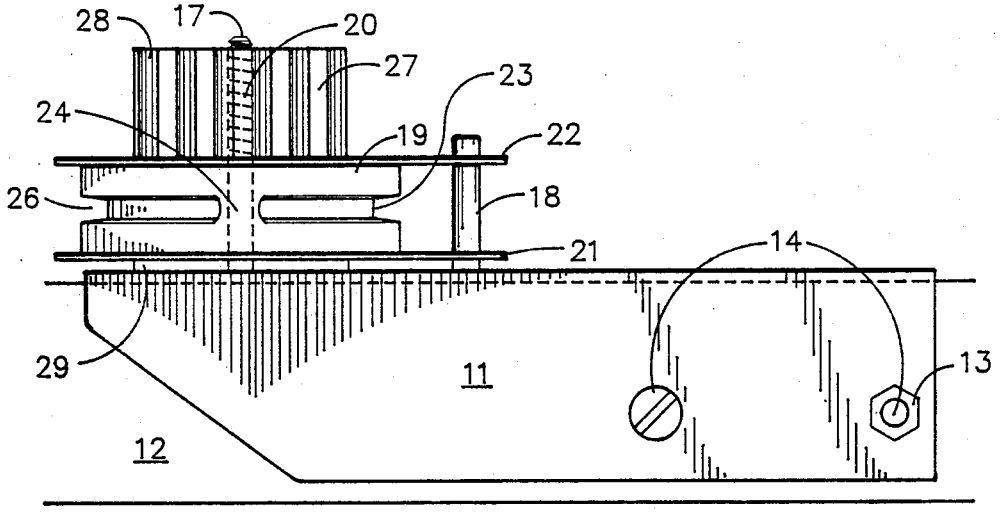
FIG. 1 is a side view of a stabilizer designed for attachment to the bottom of a tiller or top of a rudder.
Figure 2:
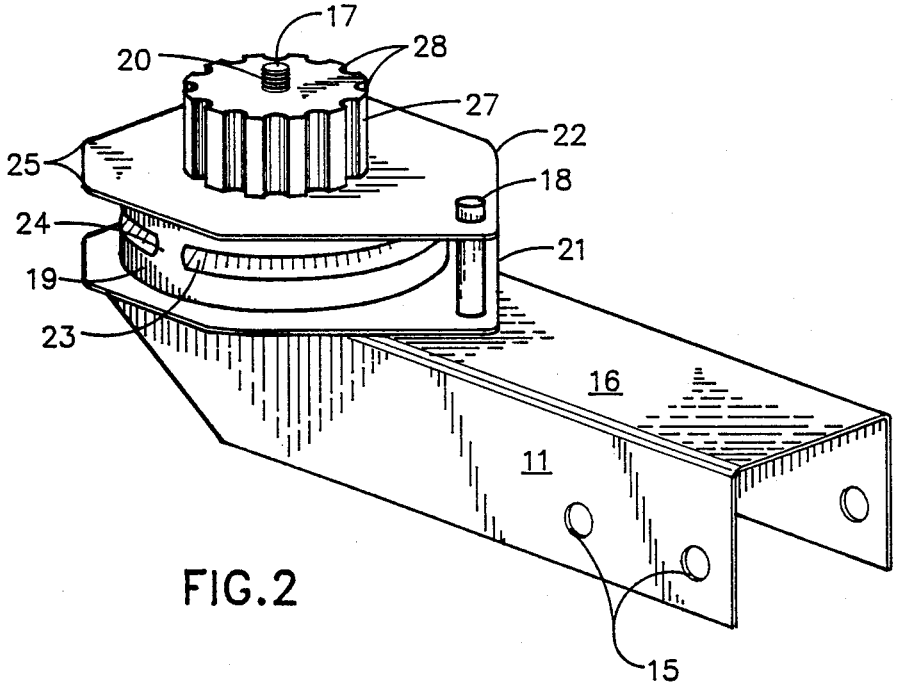
FIG. 2 is a second view of the same embodiment.

FIGS. 1 and 2 provide different views of a preferred stabilizer of this invention. The attachment plate 11 is shown, in FIG. 1, held in place on a tiller 12 by a nut 13 and bolt 14 which pass through holes 15 (FIG. 2). Attachment plate 11 has welded on its upper surface 16 a spool post 17 and a line retainer post 18. Spool post 17 has a smooth surface where it contacts spool 19 and a threaded upper section 20.

Friction plates 21 and 22 sandwich spool 19 and fit loosely over posts 17 and 18. Spool 19 has groove 23 which has an discontinuity 24 at 90 degrees from the area 25 where the lines leave the spool 19. The corners 26 of friction plates 21 and 22 are rounded for safety. Area 25 will face forward along the tiller when attached to the tiller 12 and backward along the rudder when attached to the rudder (not shown). Post 18 prevents the line from slipping off spool 19 and rotation of friction plates 21 and 22. A knob 27 with indentations 28 is twisted to increase or decrease the pressure of friction plates 21 and 22 on spool 19. Optionally, a rubber washer 29 can be inserted between surface 16 and friction plate 21.

All parts of this embodiment are made of stainless steel with the exception of spool 19 and knob 27 which are of nylon and washer 29 which is made of rubber.

Figure 3:
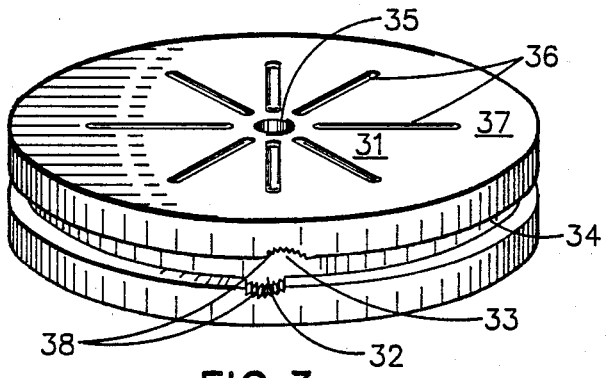
FIG. 3 depicts a spool with a modified groove with an enlargement.

FIG. 3 depicts a spool 31 having offset enlargements 32 and 33 in opposite sides of groove 34 and a vertical hole 35 running through its center. It has a sunburst pattern of shallow grooves 36 in its upper surface 37 to increase the friction caused by similar but slightly smaller shallow ridges on the inside of a friction plate (not shown) contacting the spool. The groove 34 has friction increasing ridges 38 in the enlargements 32 and 33.

Figure 4:
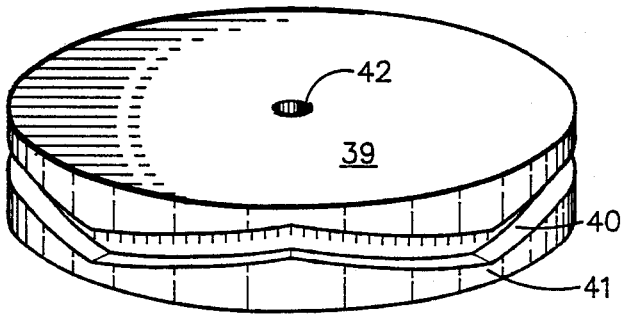
FIG. 4 depicts a zigzagged groove.

FIG. 4 depicts a spool 39 with a groove 40 generally in a zigzag shape centered in spool edge 41. A vertical hole 42 runs through the center of the spool.

Figure 5:
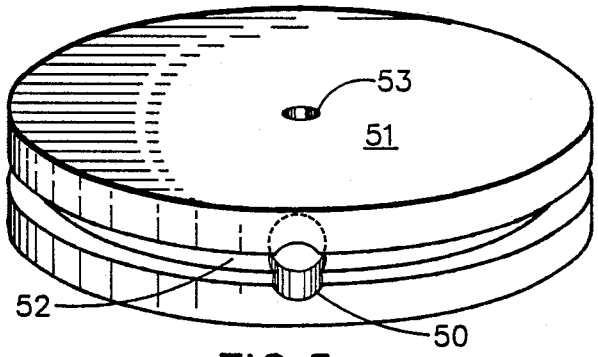
FIG. 5 depicts a "knot hole" in a spool.

FIG. 5 depicts a "knot hole" 50 which has been drilled in a spool 51 so as to straddle and deepen groove 52 for the containment of a knot in a line (not shown). The spool 51 has a perpendicular hole 53 through its center. When this embodiment is being utilized, it is preferable to loosen the yacht braid of the line on one side of the line and to pass the other side of the line through the loosened plait at a place which will cause the lines to cross at a point on the spool 51 at about 180 degrees from the knot hole 50.

Figure 6:
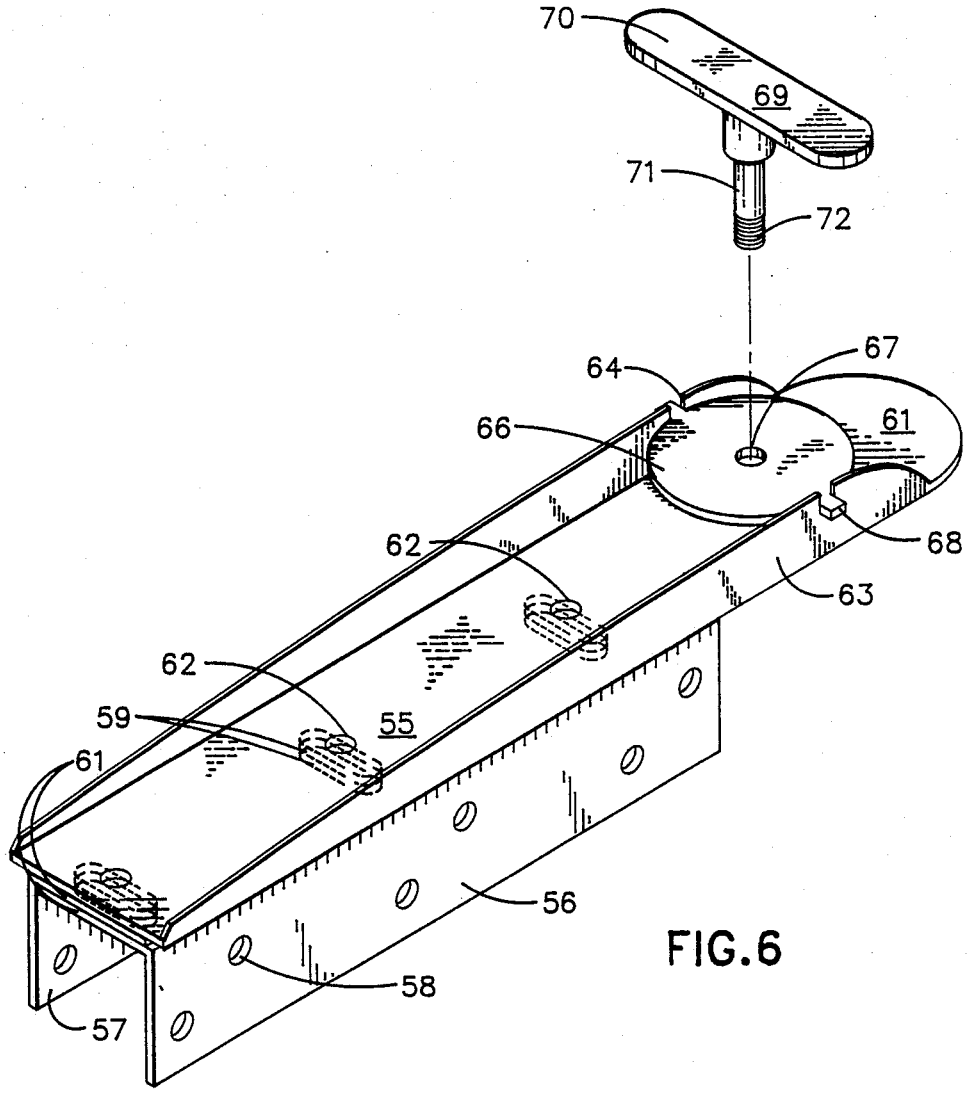
FIG. 6 depicts a "universal" stabilizer.

FIG. 6 shows a kit which can be used with rudders and tillers of different sizes. In the kit, attachment plate 55 can be utilized with or without reinforcing angles 56 and 57. Angles 56 and 57 are used to reinforce the sides of the rudder or tiller. The angles have holes 58 on the sides 56 and channels 59 on the top 61. Plate 55 has holes 62 for lag screws (not shown) which pass through channels 59 and into holes drilled into the rudder or tiller.

Plate 55 has extensions 63 with slots 64. Slots 64 are aligned with threaded hole 65. The kit has a friction plate 66 with a central hole 67 and extensions 68 which prevent the line from falling away when placed over a spool (not shown). The extensions fit into slots 64 and also prevent friction plate 66 from rotating. The friction controller 69 is made up of a handle 70 and attached spool post 71 with a threaded end 72. The spool post 71 is passed through hole 67 in friction plate 66 and into threaded hole (not shown) and attachment plate 55. Handle 70 is then turned as needed to establish a desired braking through pressure of the friction plate 66 on a spool (not shown). A hole is drilled into the rudder or tiller adjacent threaded hole 65 to ensure that attachment plate 55 is not bent when friction post 71 is screwed downwardly.

Figure 7:
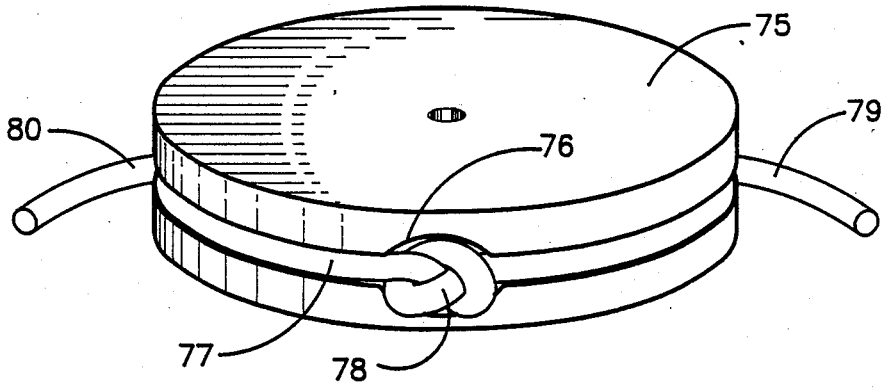
FIG. 7 depicts a spool in which a knotted line is positioned within a knot hole.
Figure 8:
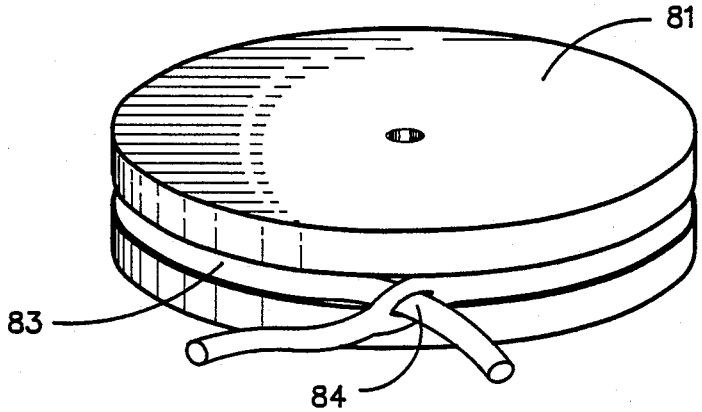
FIG. 8 depicts the opposite side of the spool of FIG. 7.

FIG. 7 utilizes a spool 75 with a modified knot hole 76. In FIG. 7, the line 77 has a knot 78 seated within knot hole 76, is wrapped around spool 75 and each of ends 79 and 80 lead to a cleat or pulley (neither shown) on the side of the boat. FIG. 8 has a spool 81 with a groove 82 having a line 83 is threaded through a hole in the loosened plait in line 83 at point 84.

GENERAL DESCRIPTION OF THE INVENTION

The attachment plate can be in several forms. It can be flat and screwed to the tiller. It can have a flat upper portion and be equipped with angle extensions having for attachment to and reinforcement of any size tiller or rudder. It can also have extensions on its upper surface to retain slack rope adjacent the spool. It can have a threaded hole for a spool post or, absent threads, can have an attached threaded bolt to position the spool post.

The spool post can be just that or it can be a part of the attachment plate or the friction controller. In the first instance it will have a smooth intermediate portion and will be threaded on both ends. It can be drilled for insertion of a locking pin. Preferably the spool post is attached to the handle or attachment plate. More preferably it is fused to the attachment plate by welding if it is metallic, adhesed with a glue or solvent bonding if it is polymeric. It can be equipped with a sleeve bearing to reduce wear as the spool spins on the post.

The preferred spool design is round with flat, parallel upper and lower surfaces. The edge between the sides can have a concave surface or the surface can be substantially flat excepting, of course, the groove. The modified groove of a width and depth slightly less than that of the line diameter for which the stabilizer is designed.

The spool size will be determined, in part, by boat size and distance of the stabilizer from the rudder. Smaller spools impose less twisting moments on the stabilizer and the boat part to which it is attached. Conversely, smaller spools impose greater stress on the wrapped line. A three inch spool with a $\frac{3}{4}$–1 inch depth is preferred for a 20 to 30 foot sail boat.

The single groove can be straight, offset or zigzagged. It can have multiple enlargements of the groove. Preferably, it has a knot hole. The knot hole both widens and deepens the groove so that it will hold a knot in the line used with the stabilizer. Preferably, one or both of the surfaces of the groove and the enlargement are roughened to increase frictional contact with the rope line. However, the roughening is not needed where a knot in a knot hole is utilized and the line is linked 180 degrees from the knot. For most purposes, a single modification, e.g. groove discontinuity, groove enlargement, grove displacement, or knot-hole works well. The most preferred knot/knot hole/link combination works particularly well and can be utilized in brisk, gusty winds. The link in the lie is obtained by several means. The two sides of the line can be tied or otherwise bound together. Preferably, the yacht braid of the line on one side of the knot is parted with a fid or other device and the other end of the line slipped through the part. A grooved width and depth of 3/16ths inch is preferred for a 20–30 foot boat utilizing a $\frac{1}{4}$ inch line.

The friction control device can be in several forms. In the first, the device is a knob with a central threaded hole. In this model, the friction control moves toward or away from the spool as the knob is turned around a spool post. In the second form, the spool post is affixed to the attachment plate. In the third, the spool post is affixed to the knob and the spool post is screwed into a threaded hole in or nut affixed to the attachment plate. When an elongated handle is used, a friction plate must be used.

A locking mechanism can be used to ensure the selected pressure is maintained when a wide knob but no friction plate is used. This can preferably be accomplished by using a wing type nut which is tightened against the upper surface of the knob. Alternately, shims, cotter pins, or other locking devices can be inserted into slots in the threads at the end of the spool post.

In a less preferred model of the invention, the attachment plate and a friction plate are hinged on one side to form a flattened clam shell. The spool is positioned by an axle which may be attached to either or neither of the attachment plate and friction plate, i.e., it may be permanently attached to the spool and merely fit into receptacles in the attachment plate and friction plate. The friction controller is positioned on the opposite side of the clam shell to enclose the spool and apply a desired pressure via the spool post.

As shown in the preferred model of FIGS. 1 and 2, one or more friction plates can be used but such plates must be prevented from rotating by a locking pin or other device (FIGS. 1 and 2). Preferably, the friction plates will be sufficiently wide to retain the turns of the line within the channel formed by the friction plates and spool edge (FIGS. 1 and 2). The friction plates can be concave and only touch the edge of the friction plate(s) when no pressure is being applied with increasing amounts of friction plates and spool being in contact with increasing pressure. One or both friction plates can have extensions designed to hold the turns of the line within the channel formed by the plates and the edge of the spool.

The line utilized with the stabilizer can be spatially stable, e.g., polyester or a chain; have limited stretch, e.g., polyamide core with a wooden polyester sheath, or even more stretch, e.g., polypropylene. Line diameter and/or strength normally will increase as the boat and rudder sizes increase.

The intended use will determine, in part, the materials of construction used in the stabilizer and line. Where the stabilizer is to be utilized on a larger boat, e.g., 35 feet, it may be constructed entirely of metal, preferably stainless steel, with a pot metal or bronze spool. Smaller or less expensive devices can utilize castable plastics for all or part of the stabilizer, e.g. castable polyamides, polycarbonates and polyformals. Composites, e.g., graphites and polyester, can also be utilized where desired.

During the wrapping of the turns, the tiller should be centered. When looking at the groove from the front or rear, depending on whether the stabilizer is mounted on the tiller or rudder respectively, non-knot hole modifications should be maintained, preferably, at 90 degrees to 180 degrees to the right. The knot hole should be 180 degrees from the viewer.

The number of turns depends on the boat width, distance from the rudder hinge and the permitted degrees arc of tiller movement. Three turns of the line provide a desired combination of rope/rope and rope/-spool friction for a 20 to 30 foot boat because the groove modification usually causes at least one turn to lie over or across the turn in the groove and this number of turns permits a good range of tiller and rudder movement. The number of the turns should increase with the stabilizer at increasing distance from the rudder hinge or pivot point. Spool diameter can be increased to reduce the number of turns in such instances. These changes are necessary to ensure the proper arc of tiller movement.

The use of the knot hole and the linked line almost eliminates the tendency of the spool to change position. However, with other models or where there is substantial stretching of the line, the line may have to be retied or the spool reset to prevent the groove modification from moving in line with the front of the tiller and changing the tiller movement range on one side or the other.

To use the stabilizer, the attachment plate is attached to the tiller, the rudder or an extension of either. The line is then wrapped around the spool and attached on opposite sides of the boat. Where the spool has a knot hole, the line is knotted at about midpoint and the knot placed in the knot hole. The point of attachment for the line should preferably be on the side of the boat at least four to six inches fore or aft of the center point of the pulley with the pulley being preferably positioned a substantial distance from the rudder hinge and at least 10 to 15 inches from the rudder hinge on a 20 to 30 foot boat.

Once the ends of the line are attached to cleats or eyebolts on each side of the stabilizer, the pressure on the spool is adjusted to a desired degree in a run in.

Those skilled in the art will immediately think of changes which might be made to the discussed invention. For example, a camming device could be substituted for the screwed on knob or handle or a clutch could be introduced to more precisely release the spool movement at predetermined pressures. Such modifications are considered to be within the scope of the appended claims, however.

I claim:

1. A stabilizer for assisting in controlling the steering of a boat comprising an attachment plate means adapted for attachment to at least one of the boat, the tiller, and rudder and extensions of either, friction controller means adapted for connection to the attachment plate means through spool post means and adapted for movement toward and away from the attachment plate means, spool means mounted between the attachment plate means and the friction controller means and having, on its edge, a groove having at least one modification for the purpose of increasing frictional contact with and between a line means.

2. The stabilizer of claim 1 wherein the modification of the groove is discontinuity.

3. The stabilizer of claim 1 wherein the modification of the groove is a zigzagging of the groove.

4. The stabilizer of claim 1 wherein the modification of the groove is a lateral enlargement of the groove.

5. The stabilizer of claim 1 wherein the modification of the groove is a knot hole in the groove.

6. The groove of claim 1 wherein the spool has, additionally, on at least one of its sides means for increasing friction on contact with friction plate means interposed between the spool and at least one of an attachment plate means and a friction controller means.

7. The groove of claim 1 wherein the spool is rotatably connected to and rotatably positioned between the attachment plate means and attachment plate means hinged at one side of the spool edge by an axle.

8. The stabilizer of claim 6 wherein friction plate means are positioned on each side of the spool means.

9. The stabilizer of claim 1 wherein the groove surface is roughened.

10. The stabilizer of claim 1 wherein the groove and modification surface are roughened.

11. The stabilizer of claim 1 wherein the groove has two modifications.

12. The stabilizer of claim 1 wherein the groove is modified by a knot hole and includes a line.

13. The stabilizer of claim 12 wherein the groove is modified by a knot hole and one turn of a line means which has a knot fitted into the knot hole which has the line linked at about 180 degrees opposite the knot.

14. The stabilizer of claim 1 wherein the groove is modified by a knot hole and includes a line means.

15. The stabilizer of claim 1 wherein the spool has additionally, on at least one of its sides means for increasing friction on contact with friction plate means interposed between at least one of the attachment plate means and friction controller means.

16. The stabilizer of claim 15 wherein the spool means and at least friction plate means have contacting friction increasing means.

17. The stabilizer of claim 1 wherein at least one friction plate means is concave on the surface contacting the spool.

* * * * *